US007071605B2

(12) United States Patent
Lee

(10) Patent No.: US 7,071,605 B2
(45) Date of Patent: Jul. 4, 2006

(54) CATHODE STRUCTURE FOR COLOR CATHODE RAY TUBE

(75) Inventor: Jae Sun Lee, Daegu-si (KR)

(73) Assignee: LG.Philips Displays Korea Co., Ltd., Gyeongsangbuk-do (KR)

( * ) Notice: Subject to any disclaimer, the term of this patent is extended or adjusted under 35 U.S.C. 154(b) by 238 days.

(21) Appl. No.: 10/701,532

(22) Filed: Nov. 6, 2003

(65) Prior Publication Data

US 2004/0140747 A1 Jul. 22, 2004

(30) Foreign Application Priority Data

Jan. 21, 2003 (KR) ..... 10-2003-0003909

(51) Int. Cl.
*H01J 1/20* (2006.01)

(52) U.S. Cl. ..... 313/337; 313/310

(58) Field of Classification Search ..... 313/346 DC, 313/618, 310, 337
See application file for complete search history.

(56) References Cited

U.S. PATENT DOCUMENTS 4,782,263 A * 11/1988 Schlack et al. ..... 313/409
5,164,631 A * 11/1992 Lee ..... 313/270
6,242,852 B1 * 6/2001 Nakamura et al. ..... 313/270
6,396,202 B1 5/2002 Sugawara et al.
6,504,293 B1 * 1/2003 Koizumi et al. ..... 313/346 R

FOREIGN PATENT DOCUMENTS

KR 1020000009007 A 2/2000

* cited by examiner

*Primary Examiner*—Joseph Williams
*Assistant Examiner*—Bumsuk Won
(74) *Attorney, Agent, or Firm*—McKenna Long & Aldridge LLP

(57) ABSTRACT

The present invention relates to a cathode ray structure for a cathode ray tube, and more particularly, to a cathode structure for a cathode ray tube capable of maximizing thermal efficiency and minimizing power consumption.

22 Claims, 7 Drawing Sheets

CATHODE STRUCTURE FOR COLOR CATHODE RAY TUBE

BACKGROUND OF THE INVENTION

1. Field of the Invention

The present invention relates to a cathode ray structure for a cathode ray tube, and more particularly, to a cathode structure for a cathode ray tube capable of maximizing thermal efficiency and minimizing power consumption.

2. Background of the Related Art

FIG. 1 is a diagram showing the structure of an already-known color cathode ray tube.

In general, the color cathode ray tube is composed of the following: a front glass panel 3; a funnel 4 including a fluorescent screen 1 inside surface of the funnel 4, the fluorescent screen 1 being covered with R, G and B fluorescent substances or phosphors; a shadow mask 2 with a color selection function; and a tube-shaped neck portion 4*a* welded to a rear side of the funnel 4.

Housed inside the neck portion 4*a* of the funnel 4 is an electron gun 5, and outside is a deflection yoke for deflecting electron beams emitted from the electron gun 5 in the horizontal and vertical directions.

Further, R, G, and B electron beams 7 emitted from the electron gun 5 are focused and accelerated by respective electrodes included in the electron gun 5, horizontally and vertically deflected by the deflection yoke 6, and eventually landed at a designated position on the fluorescent screen 1, displaying a desired image.

In other words, the electron beams 7 emitted from the electron gun are properly deflected in the horizontal and vertical directions by the deflection yoke 6. The deflected electron beams 7 then pass through beam passing holes on the shadow mask 2, and strike the fluorescent screen 1 at the front, thereby displaying a designated color image.

FIG. 2 is a diagram showing the structure of a related art electron gun in the color cathode ray tube.

The related art electron gun is largely composed of a tripolar (or triode) unit and a main lens unit. The tripolar unit with a built-in heater consists of a cathode 11, a control electrode 12, and an accelerating electrode 13 for controlling and accelerating thermoelectrons that are radiated from the electrode 11. The main lens unit includes a focus electrode 14 for focusing and eventually accelerating the electron beams generated at the tripolar unit, an anode 15 that is a final accelerating electrode, and a shield cup 16 mounted on the anode 15.

Here, the control electrode 12 is earthed, a voltage ranging 500–1000V is applied to the accelerating electrode 13, and a high voltage ranging 25–35 kV is applied to the anode 15. Applied to the focus electrode 14 are an intermediate voltage, e.g. 20–30% of the applied voltage to the anode, and a dynamic focus voltage.

In this kind of color cathode ray tube, R, G and B electron beams emitted from the electron gun 5 are deflected by the deflection yoke 6 and landed at the fluorescent screen 1, thereby displaying a designated image.

As mentioned earlier, the cathode ray tube usually includes the electron gun 5 for emitting electron beams. Further, there is a bead glass for fixing the cathode structure for radiating electron beams and the electrode structure for focusing and accelerating the electron beams.

FIG. 3 is a diagram explaining a cathode structure of the electron gun.

Referring to FIG. 3, the cathode structure is composed of the following: a base metal 42 to which an emitter 41, covered with an electron-emissive material, is applied; a sleeve 43 having a built-in heater, wherein the upper end of the sleeve 43 is inserted into the base metal 42; and a holder 45 for holding or fixing the lower end of the sleeve 43 inside the cathode ray tube through a strap 44.

The emitter 41, which is applied to the base metal 42, is covered with an electron-emissive material. The electron-emissive material has barium (Ba) as an active ingredient and further includes an alkaline-earth metal carbonate containing strontium (Sr) and calcium (Ca).

The sleeve 43 has a cylindrical shape and a built-in heater. Its front end is inserted into the base metal 42. The sleeve 43 is fitted in the cylindrical-shaped holder 45, which has a larger diameter than the sleeve 43. In short, the upper end portion of the sleeve 43 is enveloped by the base metal 42, and the lower end portion of the sleeve 43 is encompassed by the holder 45, while the central portion of the sleeve 43 is exposed to the outside. The lower end portion of the sleeve 43 and the upper end portion of the holder 45 are welded to each other through the strap 44, whereby the sleeve 43 is safely fixed inside the cylindrical-shaped holder 45.

To apply this related art cathode structure to the cathode ray tube, it is first installed in the electron gun 5 having the structure shown in FIG. 2, and the electron gun 5 is inserted into the cathode ray tube, as illustrated in FIG. 1. Then the cathode ray tube is heated up at about 600° C. and undergoes an exhaustion process to evacuate inside the tube.

Following the exhaustion process, the cathode goes through an activation process in which the cathode is heated at a high temperature in the range of 900–1000° C. Through these sequential processes, the alkaline-earth metal carbonate composing the emitter 41 becomes semiconductive and emits electrons when a certain voltage is applied to the electron gun 5.

Whether intended or not, the cathode is inevitably put in a high temperature environment, both during the manufacturing process and in the operation of the cathode.

The above operations subject the cathode structure and the electron gun including the same to a high temperature environment wherein they are heavily influenced by heat. How much the electron gun can be free of unnecessary influences of heat determines the performance and quality of the electron gun, and furthers picture quality and quality in general of the cathode ray tube mounted with the electron gun.

From this perspective, it is important to know where within the cathode structure the heat flows. First, the heater inside the sleeve 43 radiates heat, and this radiant heat is transferred to the sleeve 43. Most of the transferred heat to the sleeve 43 is conducted to the base metal by heat conduction. The heat is further conducted from the base metal 42 to the emitter 41 and oxidizes the alkaline-earth metal carbonate composing the emitter. In particular, an alkaline-earth metallic oxide is reacted with a very small amount of magnesium, silicon, or tungsten contained in the base metal 42, and shows semiconductive property. In this way, when a designated voltage is applied to the electron gun 5, the cathode emits electrons.

Some of heat in the sleeve 43 is also conducted to the strap 44 and subsequently transferred to the holder 45.

There are multiple routes of heat transfer in the related art cathode structure: one route in which the heat radiated from the heater is transferred to the base metal 42 via the sleeve 43; and the other route in which the heat radiated from the heater is transferred to the holder 45 via the strap 44 that connects the sleeve 43 and the holder 45. The route of heat transfer, or heat transfer mechanism, is totally dependent on positions of each component of the cathode structure, and often gives rise to problems like deterioration of thermal efficiency and increase in power consumption that are be described below.

Total height of the related art structure, for example, is much larger than the sum of the height of the base metal 42 and the length of the holder 45. Also, the length of the sleeve 43 is larger than twice of the length of the strap 44.

The above structural features lead to the following problems for the cathode structure embodying the same.

As described before, the radiant heat from the heater is transferred to the sleeve 43 by heat radiation. Most of the heat transferred to the sleeve 43 is subsequently conducted to the base metal 42 and the strap 44. The heat transferred to the base metal 42 is further conducted to the emitter 41.

In summary, the radiant heat from the sleeve 43 is transferred to other parts via two different mechanisms: one part of the radiant heat transferred to the sleeve 43 is conducted to the base metal 42 and the strap 44 by heat conduction, and the other part of the radiant heat is lost to outside by heat radiation.

To elaborate on the heat lost by radiation from the sleeve 43, the portion of the sleeve 43 that is not covered or encompassed by the base metal 42 and the holder 45 is exposed to the outside, making it an effective radiator through which much of the radiant heat is lost to outside. Meanwhile, the portion being covered or encompassed by the base metal 42 and the holder 45 does not lose much radiant heat. In other words, since the total height of the related art cathode structure is greater than the sum of the height of the base metal 42 and the length of the holder 45, part of the sleeve 43 is inevitably exposed to the outside. This structural limit consequently gives rise to a thermal efficiency problem through which heat is lost to the outside.

Another drawback or problem with the related art cathode structure is that the heat from the sleeve 43 is transferred by heat conduction not only to the base metal 42 but also to the strap 44. That is, when less heat is conducted to the strap 44, more heat is conducted to the base metal 42. Considering that it is better for the base metal to have more heat, the related art cathode structure should be able to reduce the heat being conducted to the strap 44. However, there is a limit in the capacity of the related art cathode structure for reducing the amount of heat that is conducted to the strap 44.

In general, the calories, Q, being transferred by heat conduction can be calculated by the formula, $Q=k\times A\times(T1-T2)/1\times t$, in which 'k' denotes a heat conductivity referring to an amount of heat energy being transferred through a material (medium), 'A' denotes a cross-sectional area, 'T' denotes a temperature, 't' denotes a time, and 'l' denotes a length. In short, the calories conducted, Q, are in inverse proportion to the length of the material.

In the related art cathode ray tube already described, the length of the strap 44 is 50% smaller than the length of the sleeve 43. Because the strap 44 is shorter than the sleeve 43, much heat is lost from the sleeve 43 to the strap 44, causing deterioration of thermal efficiency. When the thermal efficiency is lowered, the heater consumes more power. As such, it gets more difficult to attain low power consumption.

Overall, unless the base metal 42, the sleeve 43, and the holder 45 composing the cathode structure are relocated at their optimal positions (height, space, length etc.), and unless the length of the strap 44 and the height of a welding point of the strap 44 are optimally conditioned, the related art cathode structure will continuously have the same problems, e.g. low thermal efficiency, high power consumption, and deterioration of performances of other components thereby.

SUMMARY OF THE INVENTION

Accordingly, the present invention is directed to cathode structure for color cathode ray tube that substantially obviates one or more of the problems due to limitations and disadvantages of the related art.

An advantage of the invention is to solve at least the above problems and/or disadvantages and to provide at least the advantages described hereinafter.

Accordingly, one advantage of the present invention is to solve the foregoing problems by providing a cathode structure with maximized thermal efficiency and minimized power consumption.

Another advantage of the present invention is to provide a cathode structure within a cathode ray tube capable of improving thermal efficiency by making a sleeve of the cathode transfer most of the radiant heat from the cathode's heater to its electron-emissive material layer, thereby reducing the radiant heat loss to outside, and by optimizing the length of a strap that fixes the sleeve and a holder, thereby minimizing conductive heat loss to the holder and power consumption of the heater.

The foregoing and other advantages are realized by providing a cathode structure for a cathode ray tube including: a sleeve with a built-in heater; a base metal covered with an electron-emissive material, the base metal being fixed to an upper end portion of the sleeve; and a holder for encompassing the sleeve, wherein the dimensions of the cathode structure satisfy the condition of −0.6 mm (H−(C+D)) 0.4 mm, in which H denotes a height of the cathode structure, C denotes a height of the base metal, and D denotes a length of the holder.

Another aspect of the invention presents a cathode structure for a cathode ray tube including: a sleeve with a built-in heater; a base metal covered with an electron-emissive material, the base metal being fixed to an upper end portion of the sleeve; and a holder for encompassing the sleeve, wherein a length from a lower end of the base metal to an upper end of the holder is in the range of about −0.6 to about 0.4 mm.

Another aspect of the invention presents a cathode structure for a cathode ray tube including: a sleeve with a built-in heater; a base metal covered with an electron-emissive material, the base metal being fixed to an upper end portion of the sleeve; and a holder for encompassing the sleeve, wherein a height of the cathode structure, H, a height of the base metal, C, and a length of the holder, D, satisfy a relation of $H \leqq C+D$.

Additional advantages and features of the invention will be set forth in part in the description which follows and in part will become apparent to those having ordinary skill in the art upon examination of the following or may be learned from practice of the invention. The advantages of the invention may be realized and attained as particularly pointed out in the appended claims.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF EMBODIMENTS

Reference will now be made in detail to an embodiment of the present invention, example of which is illustrated in the accompanying drawings.

Figure 4:
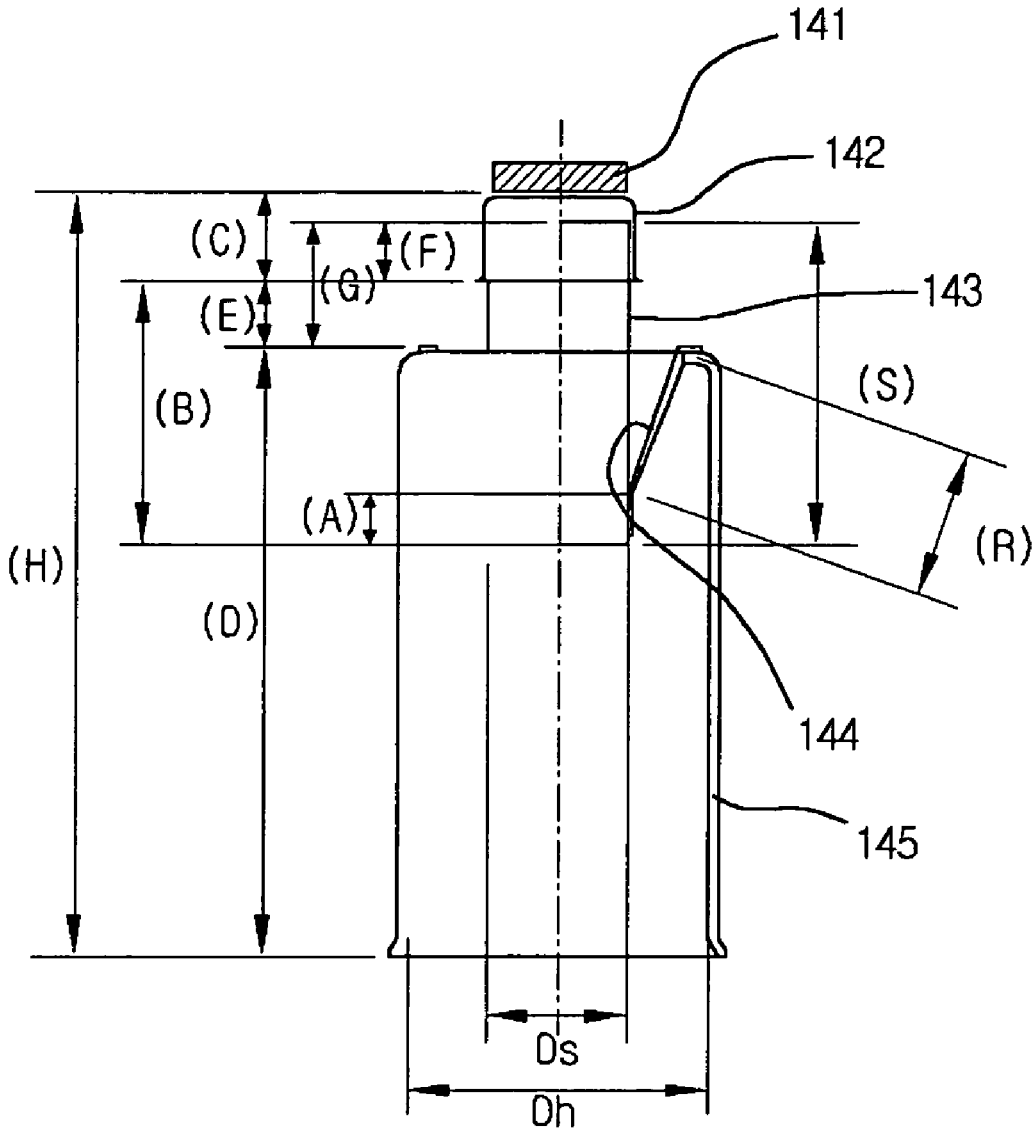
FIG. 4 is a diagram showing the structure of a cathode structure for a cathode ray tube according to the present invention.

Referring first to FIG. 4, the cathode structure for a cathode ray tube according to the present invention is composed of an emitter 141, a base metal 142, a sleeve 143 with a built-in heater, a strap 144, and a holder 145.

The emitter 141, covered with an electron-emissive material layer, is applied to the base metal 142. The electron-emissive material has barium (Ba) as an active ingredient and further includes an alkaline-earth metal carbonate containing strontium (Sr) and calcium (Ca).

The sleeve 143 has a cylindrical shape and a built-in heater (not shown). The front end of the sleeve is inserted into the base metal 142. Hence, an upper end portion of the sleeve 143 is covered by the base metal 142. In addition, the sleeve 143 is fitted in the cylindrical-shaped holder 145 with a larger diameter than that of the sleeve 143; and a lower end portion of the sleeve 143 is encompassed by the holder 145. In short, the upper end portion of the sleeve 143 is covered by the base metal 142, and the lower end portion of the sleeve 143 is encompassed by the holder 145. A significant advantage of the present invention is not to expose any portion of the sleeve 143 to outside, or to optimize or minimize a length of an exposed portion of the sleeve to the extent possible.

The lower end portion of the sleeve 143 and the upper end portion of the holder 145 are welded to each other through the strap 144, whereby the sleeve 143 is safely fixed inside the cylindrical-shaped holder 145.

In FIG. 4, "A" denotes a height of a strap 144 welding point on the basis of the lower end of the sleeve 143; "B" denotes a length (distance) from a lower end of the base metal 142 to the lower end of the sleeve 143; "C" denotes a height of the base metal 142; "D" denotes a length of the holder 145; "E" denotes a length (distance) from the low end of the base metal 142 to an upper end of the holder 145; "F" denotes a length (distance) from an upper end of the sleeve 143 to the lower end of base metal 142; "G" denotes a length (distance) from the upper end of the sleeve 143 to the upper end of the holder 145; "H" denotes a total height of the cathode structure; "S" denotes a length of the sleeve 143; "R" denotes a length of the strap 144; "Ds" denotes an outside diameter of the sleeve 143; and "Dh" denotes an inside diameter of the holder 145.

In this diagram, the length (distance) from the low end of the base metal 142 to the upper end of the holder 145, E, is in the range of about −0.6 to about 0.4 mm. In one configuration, the length E is in the range of about −0.6 to about 0.2 mm, and possibly, about −0.5 to about 0.0 mm. When E has a positive (+) value, it means that the sleeve 143 is exposed to the outside. Meanwhile, when E is 0 or has a negative (−) value, it means that the sleeve 143 is not exposed to the outside at all.

In addition, the total height of the cathode structure, H, and the height of the base metal 142, C, and the length of the holder 145, D, are in particular relation to one another such that H−(C+D) is in the range of about −0.6 to about 0.4 mm. Similar to E, when H−(C+D) has a positive (+) value, it means that the sleeve 143 is exposed to the outside. When H−(C+D) is 0 or has a negative (−) value, it means that the sleeve 143 is not exposed to the outside at all. In one configuration, the total height of the cathode structure, H, is smaller or less than the sum of the height of the base metal 142, C, and the length of the holder 145, D, that is, $H \leqq (C+D)$. As before, when $H \leqq (C+D)$, the sleeve 143 is not exposed to the outside at all.

Figure 5:
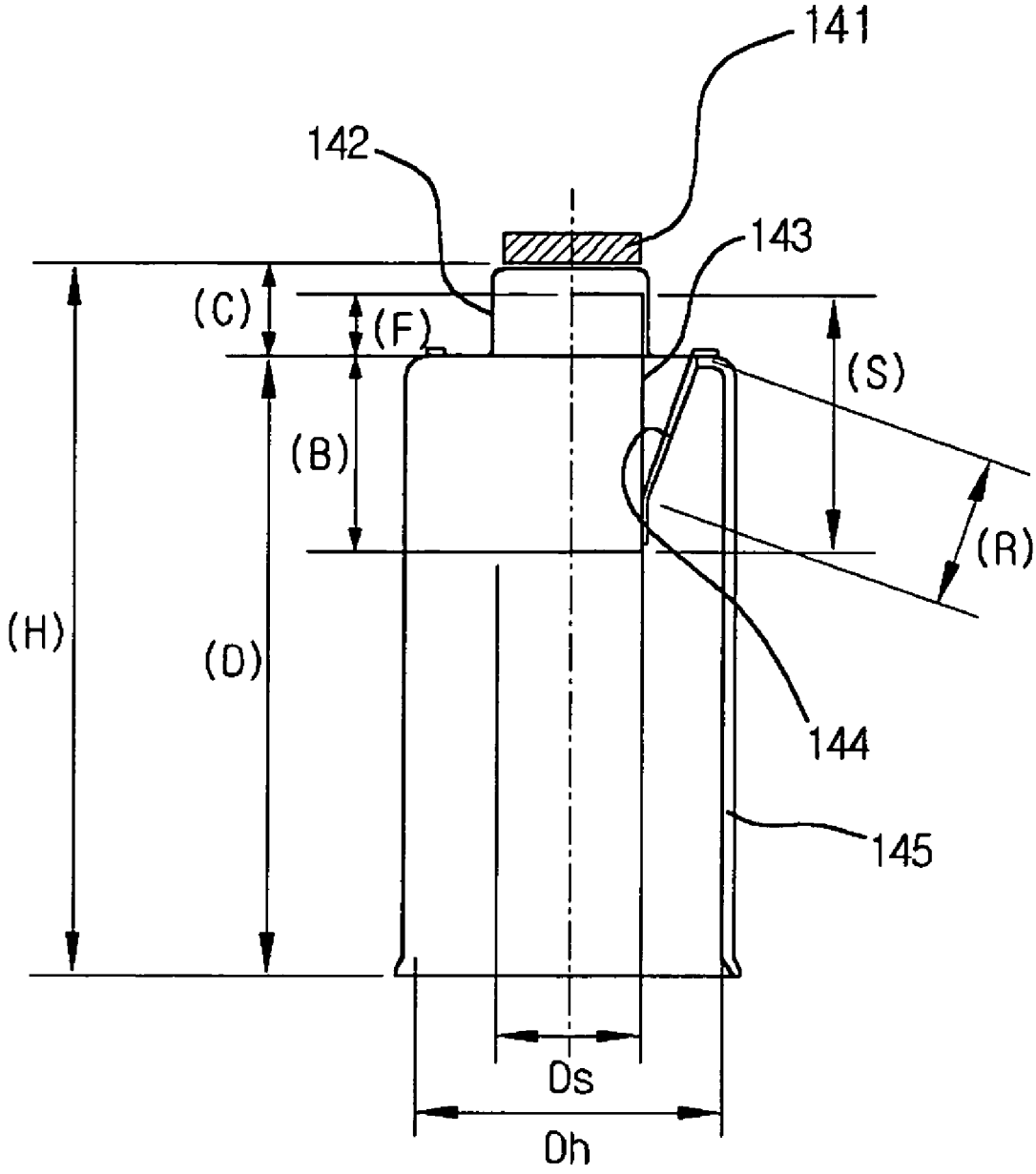
FIG. 5 is a diagram showing a first embodiment of the cathode structure for a cathode ray tube according to the present invention, in which an optimal strap length is determined, and the welding point at which the strap is affixed to the sleeve is located accordingly.
Figure 6:
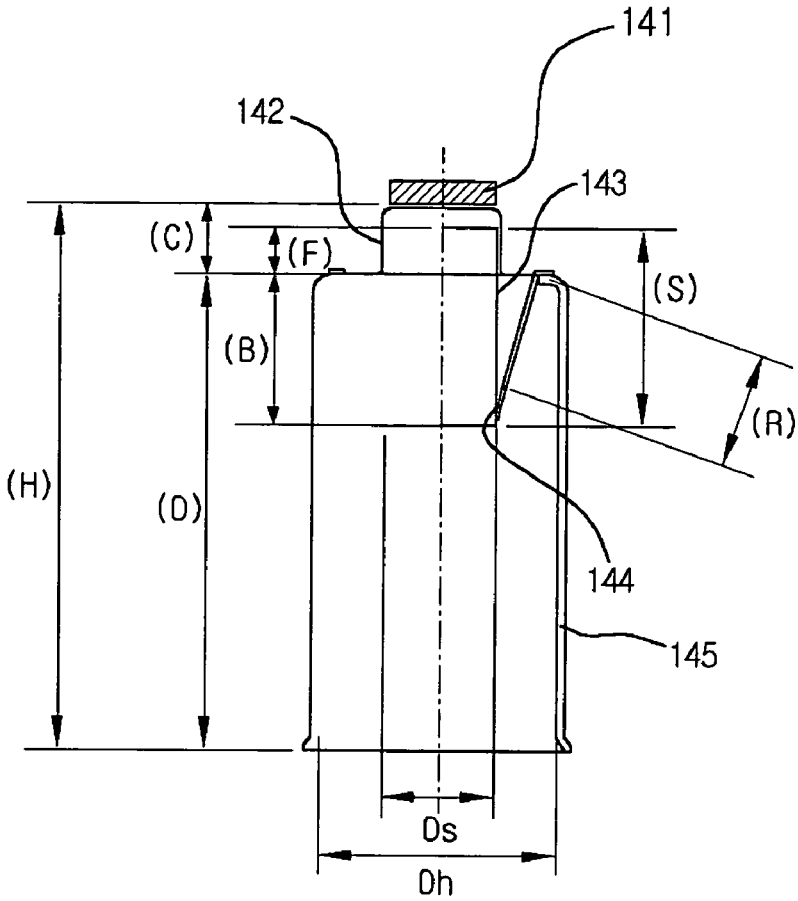
FIG. 6 is a diagram showing a second embodiment of the cathode structure for a cathode ray tube according to the present invention, in which an optimal location of the welding point at which the strap is affixed to the sleeve is determined, and the required strap length is determined accordingly.

FIG. 5 and FIG. 6 illustrate a case in which the sleeve 143 of the cathode structure is not exposed to the outside, that is, when the length from the low end of the base metal 142 to the upper end of the holder 145, E, is 0 or has a negative (−) value or when H−(C+D) is 0 or has a negative (−) value, or when $H \leqq (C+D)$.

Figure 7:
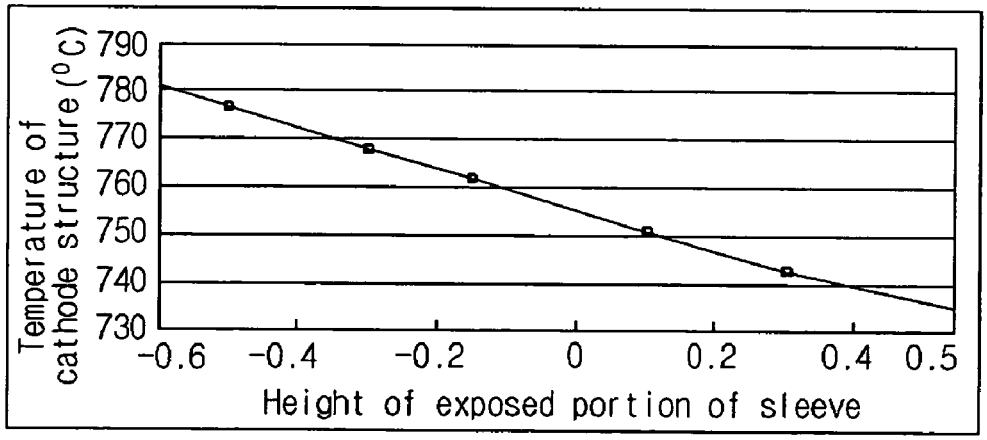
FIG. 7 is a graph featuring a temperature characteristic of the cathode structure of the present invention with respect to a height of an externally exposed part of a sleeve.
Figure 8:
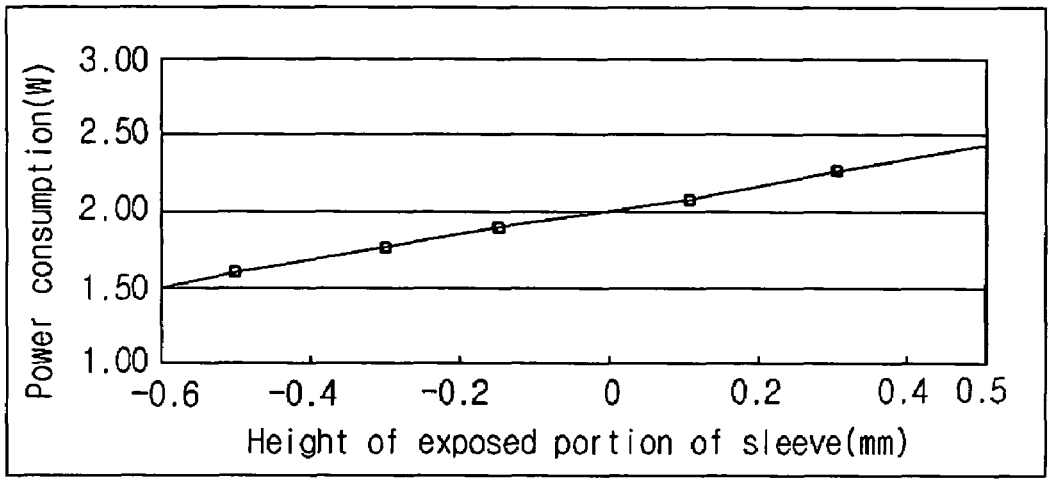
FIG. 8 is a graph featuring a power consumption characteristic of a heater with respect to the height of the externally exposed part of the sleeve according to the present invention.
Figure 9:
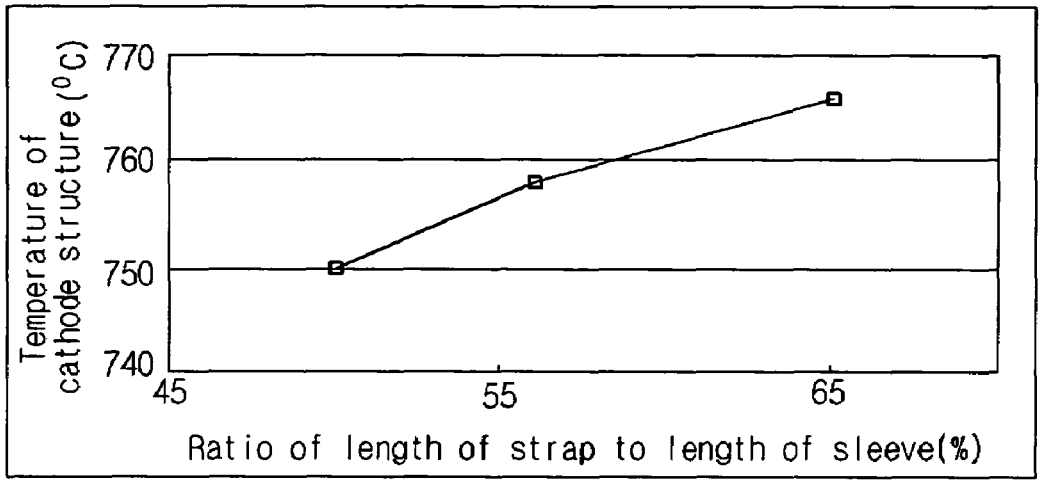
FIG. 9 is a graph featuring the temperature characteristic of the cathode structure of the present invention with respect to a ratio of a length of a sleeve to a length of a strap according to the present invention.

As the results of tests performed on the embodiments shown in FIGS. 4 and 5 demonstrate in FIGS. 7 through 9, in order to improve the thermal efficiency and realize low power consumption, the base metal 142, the sleeve 143, the holder 145, and the strap 144 are optimally positioned under the following conditions.

In the embodiment shown in FIG. 5, the length of the strap 144, R, ranges from about 1.9 to about 3.1 mm, and the difference between the outside diameter of the sleeve 43, Dh, and the inside diameter of the holder 45, Ds, or (Dh−Ds), ranges from about 0.6 to about 0.9 mm. Also, a ratio of the length of the strap 144, R, to the length of the sleeve 143, S, i.e. R/S, is not smaller than about 55%, more may be between about 60 to about 80%. A length of the upper portion of the base metal 143 (thickness, i.e. C−F) may be in the range of about 0.05 to about 0.25 mm, and $G+D \geqq F+D$.

In the embodiment shown in FIG. 6, the height of the strap 144 welding point from the lower end of the sleeve 143, A, is not larger than about 1.0 mm, and the length (distance) from the lower end of the base metal 142 to the lower end of the sleeve 143, B, is in the range of about 2.5 to about 4.0 mm. As in the embodiment shown in FIG. 5, the difference between the outside diameter of the sleeve 43, Dh, and the inside diameter of the holder 45, Ds, or (Dh−Ds), ranges from about 0.6 to about 0.9 mm.

The height of the base metal 142, C, may be equal or greater than about 0.5 mm, and may be in the range of about 0.65 to about 1.1 mm.

The length of the holder 145, D, ranges about 4.5 to about 8.0 mm; the length from the upper end of the sleeve 143 to the lower end of base metal 142, F, ranges from about 0.25 to about 0.85 mm; the length from the upper end of the sleeve 143 to the upper end of the holder 145, G, ranges from about 0.4 to about 0.8 mm; and the length of the sleeve 143, S, ranges from about 2.9 to about 5.5 mm.

Turning back to FIG. 4 and FIG. 5, where the cathode structure for a cathode ray tube according to the present invention is illustrated, the heater (not shown) is built in the sleeve 143, and the cap-shaped base metal 142 is fixed onto the upper end portion of the sleeve 143. On the top surface of the base metal 142 is the emitter 141 covered with the electron-emissive material (layer).

In the embodiments shown in FIG. 5 and FIG. 6, the height of the base metal 142, C, may be about 0.9 mm. The sleeve 143 is placed inside the cylindrical-shaped holder 145 and fixed by the strap 144. There are three straps 144 evenly spaced about 120 degrees apart at the lower end portion of the sleeve 143 and the upper portion of the holder 145, supporting each portion. The height of the holder 145, D, is set to be about 6.4 mm. Thus, the sum of the height of the base metal 142, C, and the height of the holder 145, D, may be about 7.3 mm.

If the height of the cathode structure, H, is greater than about 7.3 mm, then H−(C+D) has a positive value, whereas if the H is less than about 7.3 mm, the H−(C+D) has a negative value. When the H−(C+D) is a positive value, it means that the sleeve 143 is exposed to the outside, and when the H−(C+D) is zero or a negative value, it means that the sleeve 143 is not exposed to the outside at all.

The height of the exposed portion of the sleeve 143 can be calculated by the formula, H−(C+D), wherein H is the height of the cathode structure, C is the height of the base metal, and D is the height of the holder. If the result of H−(C+D) is less than or equal to 0.0 mm, it means that the sleeve 143 is not exposed at all, while if it is greater than 0.0, it means that the sleeve 143 is exposed to the outside.

FIG. 7 illustrates how the thermal efficiency changes as the height of the cathode structure, H, is changed. More specifically, FIG. 7 is a graph featuring a temperature characteristic of the cathode structure of the present invention with respect to the height of an externally exposed part of the sleeve. In FIG. 7, (H−(C+D)) of the cathode structure was used on the x-axis, and the temperature of the metal base 142 of the cathode structure was used on the y-axis.

Normally, the result of (H−(C+D)) in the related art cathode structure is greater than 0.5 mm, and the temperature of the cathode structure as tested was lower than 736° C. However, in the present invention, the result of (H−(C+D)) is smaller than 0.0 mm, and the temperature of the cathode structure as tested is about 755° C., which is 10° C. higher than the related art one. Also, when the result of (H−(C+D)) is −0.5 mm, the temperature of the cathode structure as tested was 775° C., which is 30° C. higher than the related art one. As shown in FIG. 7, the less the sleeve 143 is exposed to the outside, the higher the thermal efficiency gets.

FIG. 8 is a graph featuring a power consumption characteristic of the heater with respect to the height of the externally exposed part of the sleeve according to the present invention. In FIG. 8, x-axis indicates the result of (H−(C+D)), and the y-axis indicates the power consumption (W) of the heater.

Typically, the power consumption of the related art cathode structure was 2.4 W. However, the power consumption of the cathode structure according to the present invention, provided that (H−(C+D)) is about 0.0 mm, was 2.0 W, and when (H−(C+D)) is about −0.5 mm, the power consumption was 1.6 W. That is, the less the sleeve 143 is exposed to the outside, the higher the thermal efficiency gets.

To summarize, as the height of the exposed portion of the sleeve 143 to the outside, i.e. (H−(C+D)), is decreased, the thermal efficiency is much improved and the power consumption is greatly reduced.

The height of the exposed portion of the sleeve 143 to the outside, i.e. (H−(C+D)), is in inverse proportion to the thermal efficiency. However, when (H−(C+D)) is smaller than about −0.5 mm, the following problem might occur. The cathode structure is installed in the electron gun for use in the cathode ray tube. The assembly of the cathode structure should be done very carefully to maintain a cut-off voltage, keeping a designated space between the cathode structure and the electrode of the electron gun. The space between the emitter 141 for emitting electrons and the electrode of the electron gun should be in the range of 50–100 μm. Hence, as (H−(C+D)) is decreased, the gap between the upper end portion of the holder 145 and the electrode of the electron gun is narrowed.

When the gap between the upper end portion of the holder 145 and the electrode of the electron gun is narrowed, a problem occurs especially when a designated voltage is applied to the electron gun in operation of the cathode ray tube. For instance, when the distance between the upper portion of the holder 145 and the electrode of the electron gun is smaller than about 0.5 mm, there is a high possibility that a discharge or a spark will occur between the electrode of the electron gun and the holder 145 of the cathode structure. When a discharge occurs, the emitter 141 is severely damaged so that it cannot emit electrons stably.

To obviate such problem, (H−(C+D)) should be at least about −0.6 mm, and more particularly, greater than about −0.5 mm all the time.

In short, when the (H−(C+D)) ranges from about −0.5 to about 0.0 mm, the thermal efficiency of the cathode structure is high, and the emitter can emit electrons more stably.

An operation of the cathode structure according to the present invention is explained below.

Figure 1:
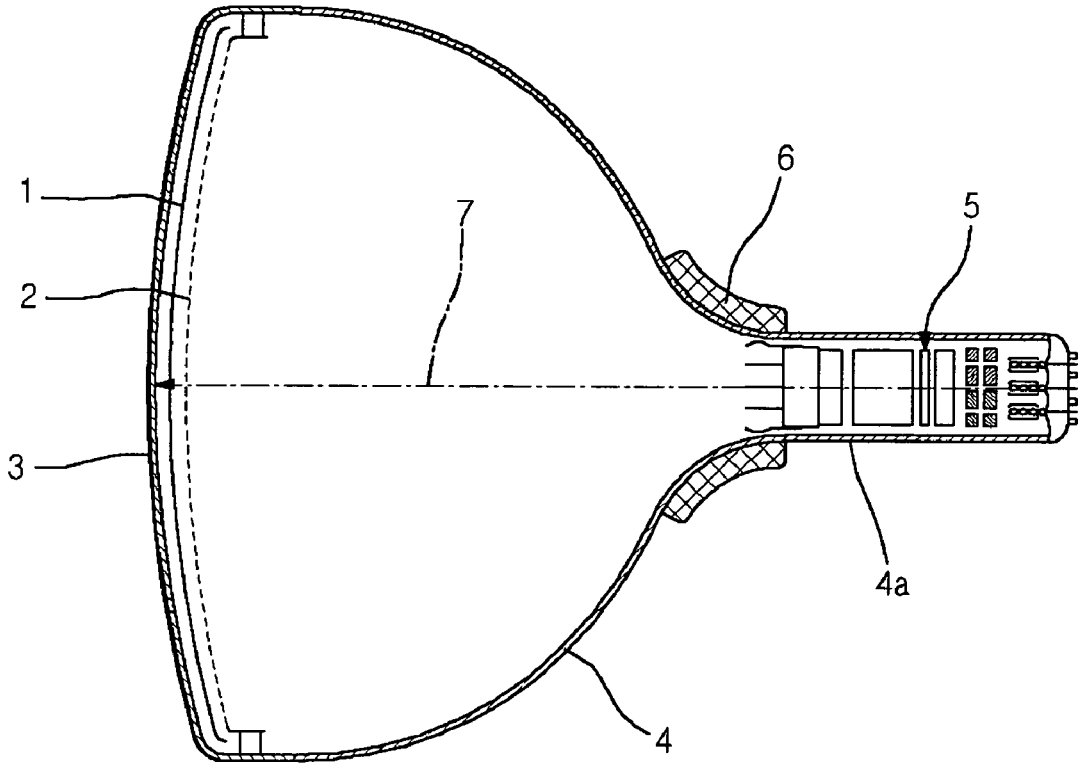
Fig.1 (Related Art)
FIG. 1 is a schematic cross section of a known color cathode ray tube.
Figure 2:
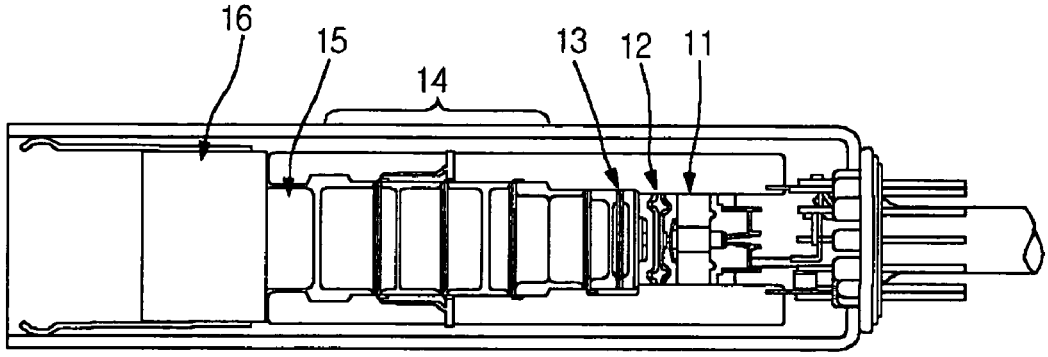
Fig.2 (Related Art)
FIG. 2 is a schematic cross section of a known electron gun.
Figure 3:
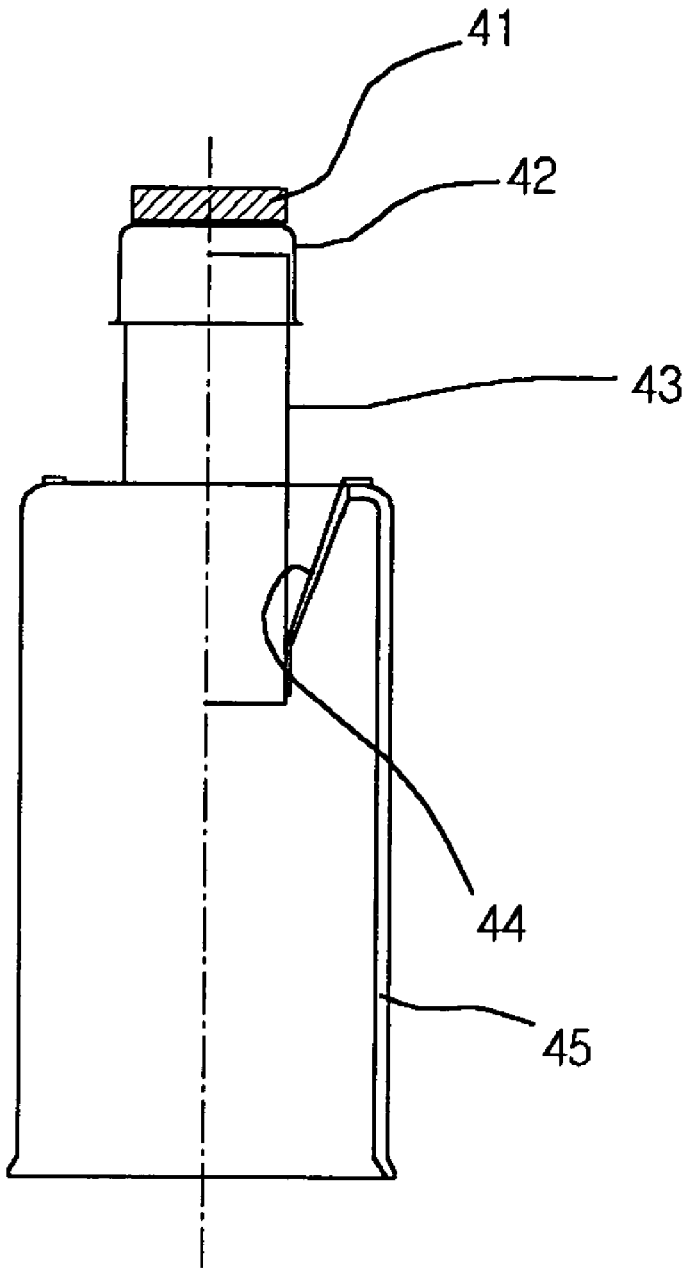
Fig.3 (Related Art)
FIG. 3 is a diagram explaining a cathode structure in a related art.

To begin with, the cathode structure is installed in the electron gun 5 having the structure shown in FIG. 2, and the electron gun, as illustrated in FIG. 1, is inserted into the cathode ray tube. Then the cathode ray tube is heated up at about 600° C. and undergoes an exhaustion process to evacuate inside the tube.

Following the exhaustion process, the cathode goes through an activation process in which the cathode is heated at a high temperature in the range of 900–1000° C. Through these sequential processes, the alkaline-earth metal carbonate composing the emitter 41 becomes semiconductive, and emits electrons when a certain voltage is applied to the electron gun. These electrons (or electron beams) are focused and accelerated by the electrodes composing the electron gun, deflected in the horizontal and vertical directions by the deflection yoke, and landed at a designated position on the fluorescent screen, displaying an image.

In other words, the electron beams emitted from the electron gun are properly deflected in the horizontal and vertical directions by the deflection yoke. The deflected electron beams then pass through beam passing holes on the shadow mask and strike the fluorescent screen at the front, thereby displaying a designated color image.

Heat Transfer Characteristics

Described below is a heat transfer characteristic of the cathode structure for a cathode ray tube according to the present invention.

When the heater (not shown) inside the sleeve 143 radiates heat, the radiant heat is transferred to the sleeve 143. The transferred heat to the sleeve 143 is then conducted to the base metal 142 via conduction. The heat is further transferred from the base metal 142 to the emitter 141 by heat conductivity, and oxidizes the alkaline-earth metal carbonate composing the emitter. In particular, an alkaline-earth metallic oxide is reacted with a very small amount of magnesium, silicon, or tungsten contained in the base metal 42, and shows semiconductive property. In this way, when a designated voltage is applied to the electron gun 5, the cathode emits electrons.

According to the present invention, since the sleeve 143 is completely covered by the base metal 142 or the holder 145, or is otherwise encompassed in an optimized position relation, the heat loss of the sleeve 143 of the present invention to outside by heat radiation, compared to that of the related art cathode structure, is very little.

Moreover, because the length of the strap 144, R, of the cathode structure according to the present invention is in the range of 1.9–3.1 mm, which is a lot longer than the length of the strap 144 of the related art cathode structure, much less heat is transferred by heat conduction to the holder.

As described before, calories, Q, being transferred by heat conduction can be calculated by the formula, $Q=k\times A\times(T1-T2)/1\times t$, in which 'k' denotes a heat conductivity referring to an amount of heat energy being transferred through a material (medium), 'A' denotes a cross-sectional area, 'T' denotes a temperature, 't' denotes a time, and 'l' denotes a length. Now that the length of the heat transfer route, R, of the cathode structure according to the present invention is increased, the calories transferred by heat conduction are also reduced.

The end result is that most of the radiant heat from the heater to the sleeve 143 is conducted to the metal base 142, improving the thermal efficiency.

As discussed before, the length, R, of the strap 144 is the distance from the point at which the lower end portion of the sleeve 143 and the strap 144 are welded together to the point at which the upper end portion of the holder 145 and the strap 144 are welded together. In the present invention, the strap 144 is welded to the lower end portion of the sleeve 143, more particularly, to a point at least about ⅓ the length of the sleeve, measured from the lower end of the sleeve 143. The strap is welded in this manner because when the length, R, of the strap 144 is elongated too much, the sleeve 143 might become eccentric. When that happens, the alignment of the electrodes in the electron gun is destroyed, and as a result, the quality of the electron gun is severely damaged. Welding the length, R, of the strap 144 to an at least ⅓ point of the length, S, of the sleeve 143 overcomes this problem.

FIG. 9 shows a graph featuring the temperature characteristic of the cathode structure of the present invention with respect to a ratio of the length, S, of the sleeve 143 to the length, R, of the strap 144. Particularly, the plot shows the thermal efficiency of the cathode with respect to R/S×100%, or R'/S×100%, as represented by temperature changes.

In an exemplary embodiment of the present invention which has been tested, the length, S, of the sleeve 143 of the cathode structure was set to be 3.7 mm, and the lengths, R, of the strap 144 at that time were 2.1 mm and 2.4 mm. The ratio of R/S was thus 56% and 65%, respectively. When the ratio of R/S is about 50%, the temperature of the cathode structure is 750° C. However, when the ratios of R/S are 56% and 65%, the temperatures of the cathode structure are 758° C. and 766° C., respectively, being 10° C. higher than the previous case in which the ratio of R/S is less 50%. That is, the smaller the ratio of the length, R, of the strap 144 to the length, S, of the sleeve 143, the less the heat loss by heat conduction through the straps. As a result, relatively more heat is conducted to the metal base 142, increasing the temperature of the cathode structure and eventually improving the thermal efficiency thereof. Therefore, the ratio of R/S may be higher than about 55%, and more preferably, may be in the range of about 60 to about 80%.

In the cathode structure of the present invention, the sleeve is covered by the base metal 142 and the holder 145 such that the surface of the sleeve is not exposed to the outside at all.

With the above feature, there is almost no heat loss to outside by heat radiation and the thermal efficiency of the present invention is much improved. Also, because the length of the strap 144, which is welded to the lower end portion of the sleeve, is elongated compared to the related art cathode structure, much less heat is conducted through the strap 144, thereby improving the thermal efficiency and reducing power consumption of the heater.

While the invention has been shown and described with reference to certain preferred embodiments thereof, it will be understood by those skilled in the art that various changes in form and details may be made therein without departing from the spirit and scope of the invention as defined by the appended claims.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A cathode structure for a cathode ray tube comprising:

a sleeve with a built-in heater;

a base metal covered with an electron-emissive material, the base metal being fixed to an upper end portion of the sleeve; and a holder for encompassing the sleeve, wherein H denotes a height of the cathode structure, C denotes a height of the base metal, D denotes a length of the holder, and H, C, and D satisfy the condition of $-0.6\text{ mm}\leqq(H-(C+D))\leqq 0.4\text{ mm}$.

2. The cathode structure as claimed in claim 1, wherein (H−(C+D)) is in the range of −0.6 mm to 0.2 mm.

3. The cathode structure as claimed in claim 1, wherein a length, B, from a lower end of the base metal to a lower end of the sleeve is in the range of 2.5 mm to 4.0.

4. The cathode structure as claimed in claim 1, wherein the height, C, of the base metal is greater than or equal to about 0.5 mm.

5. The cathode structure as claimed in claim 4, wherein the height, C, of the base metal is in the range of 0.6 mm to 1.1 mm.

6. The cathode structure as claimed in claim 1, wherein the length, D, of the holder is in the range of 4.5 mm to 8.0 mm.

7. The cathode structure as claimed in claim 1, wherein a length, F, from an upper end of the sleeve to a lower end of the base metal is in the range of 0.25 mm to 0.85 mm.

8. The cathode structure as claimed in claim 1, wherein a length, G, from an upper end of the sleeve to an upper end of the holder is in the range of 0.4 mm to 0.8 mm.

9. The cathode structure as claimed in claim 1, wherein a length, S, of the sleeve is in the range of 2.9 mm to 5.5 mm.

10. The cathode structure as claimed in claim 1, wherein a difference between an inside diameter, Dh, of the holder and an outside diameter, Ds, of the sleeve, namely (Dh−Ds), is in the range of 0.6 mm to 0.9 mm.

11. The cathode structure as claimed in claim 1, wherein a length of an upper portion (thickness) of the base metal is in the range of 0.05 mm to 0.25 mm.

12. The cathode structure as claimed in claim 1, wherein a length from a lower end of the base metal to an upper end of the sleeve, F, the length of the holder, D, and a length from the upper end of the sleeve to an upper end of the holder, G satisfy a relation of $G+D \geqq F+D$.

13. The cathode structure as claimed in claim 1, further comprising a strap for fixing the sleeve inside the holder.

14. The cathode structure as claimed in claim 13, wherein a height, A, of a strap welding point from a lower end of the sleeve is not larger than 1.0 mm.

15. The cathode structure as claimed in claim 13, wherein a length, R, of the strap is in the range of 1.9 mm to 3.1 mm.

16. The cathode structure as claimed in claim 13, wherein a ratio of a length of the strap, R, to a length of the sleeve, S, namely R/S, is in the range of 55% to 80%.

17. The cathode structure as claimed in claim 13, wherein a ratio of a length of the strap, R, to a length of the sleeve, S, namely R/S, is in the range of 60 to 80%.

18. The cathode structure as claimed in claim 13, wherein the point at which the strap is affixed to the sleeve is located at or above a distance from a lower end of the sleeve which is equal to about ⅓ of the length of the sleeve.

19. A cathode structure for a cathode ray tube comprising:

a sleeve with a built-in heater;

a base metal covered with an electron-emissive material, the base metal being fixed to an upper end portion of the sleeve; and a holder for encompassing the sleeve, wherein a length from a lower end of the base metal to an upper end of the holder is in the range of −0.6 mm to 0.4 mm.

20. The cathode structure as claimed in claim 19, further comprising a strap for fixing the sleeve inside the holder.

21. The cathode structure as claimed in claim 19, wherein the length from the lower end of the base metal to the upper end of the holder is in the range of −0.6 mm to 0.2 mm.

22. A cathode structure for a cathode ray tube comprising:

a sleeve with a built-in heater;

a base metal covered with an electron-emissive material, the base metal being fixed to an upper end portion of the sleeve;

a holder for encompassing the sleeve, wherein a height of the cathode structure, H, a height of the base metal, C, and a length of the holder, D, satisfy a relation of $H \leqq C+D$; and a strap for fixing the sleeve inside the holder.

* * * * *